US009109345B2

(12) United States Patent
Okamura et al.

(10) Patent No.: US 9,109,345 B2
(45) Date of Patent: Aug. 18, 2015

(54) CONSTRUCTION MACHINE, METHOD FOR CONTROLLING CONSTRUCTION MACHINE, AND PROGRAM FOR CAUSING COMPUTER TO EXECUTE THE METHOD

(75) Inventors: Kenji Okamura, Hiratsuka (JP); Masashi Ichihara, Hiratsuka (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 109 days.

(21) Appl. No.: 13/254,930

(22) PCT Filed: Mar. 5, 2010

(86) PCT No.: PCT/JP2010/053605
§ 371 (c)(1),
(2), (4) Date: Sep. 6, 2011

(87) PCT Pub. No.: WO2010/101233
PCT Pub. Date: Sep. 10, 2010

(65) Prior Publication Data

US 2011/0318157 A1 Dec. 29, 2011

(30) Foreign Application Priority Data

Mar. 6, 2009 (JP) ..... 2009-053941

(51) Int. Cl.
*E02F 9/00* (2006.01)
*E02F 3/30* (2006.01)
(Continued)

(52) U.S. Cl.
CPC ..... *E02F 9/2207* (2013.01); *E02F 3/436* (2013.01)

(58) Field of Classification Search
CPC ..... E02F 9/2207; E02F 3/436; E02F 3/30; E02F 9/00
USPC ..... 701/50; 414/687, 680
See application file for complete search history.

(56) References Cited

U.S. PATENT DOCUMENTS 4,938,023 A * 7/1990 Yoshino ..... 60/427
5,267,440 A * 12/1993 Nakamura et al. ..... 60/426
(Continued)

FOREIGN PATENT DOCUMENTS

CN 1077187 C 10/1993
CN 1229449 A 9/1999
(Continued)

OTHER PUBLICATIONS

International Search Report from International Application No. PCT/JP2010/053605, mailed Apr. 13, 2010, 2 pages.
(Continued)

*Primary Examiner* — Yonel Beaulieu
(74) *Attorney, Agent, or Firm* — Fish & Richardson P.C.

(57) ABSTRACT

A controller constituting a construction machine includes: a target value computing unit that generates a speed target value of a boom based on a lever manipulating signal; a target value correcting unit that corrects the speed target value; and a command signal output unit that outputs a command signal to a boom driving device based on the corrected speed target value. The target value correcting unit includes: a motion information acquiring unit that acquires motion information on a motion of an arm; a maximum value determining unit that determines based on the motion information a maximum correction value for reducing suppression of a floating motion by a floating motion suppressing unit as the motion of the arm becomes faster; and a correction value regulating unit that corrects the speed target value based on the maximum correction value.

20 Claims, 13 Drawing Sheets

(51) Int. Cl.
*E02F 9/22* (2006.01)
*E02F 3/43* (2006.01)

(56) References Cited

U.S. PATENT DOCUMENTS

| | | | | | |
|---|---|---|---|---|---|
| 5,361,211 | A * | 11/1994 | Lee et al. | 701/50 |
| 5,575,149 | A * | 11/1996 | Stoychoff | 60/469 |
| 5,642,616 | A * | 7/1997 | Park | 60/426 |
| 5,953,977 | A * | 9/1999 | Krishna et al. | 91/361 |
| 5,999,872 | A * | 12/1999 | Kinugawa et al. | 701/50 |
| 6,076,029 | A * | 6/2000 | Watanabe et al. | 701/50 |
| 6,098,322 | A * | 8/2000 | Tozawa et al. | 37/414 |
| 6,275,757 | B1 * | 8/2001 | Watanabe et al. | 701/50 |
| 6,356,829 | B1 * | 3/2002 | Fan et al. | 701/50 |
| 6,360,538 | B1 * | 3/2002 | McGowan et al. | 60/468 |
| 6,408,622 | B1 * | 6/2002 | Tsuruga et al. | 60/422 |
| 6,422,804 | B1 * | 7/2002 | Gitter | 414/695.5 |
| 6,459,976 | B1 * | 10/2002 | Chen et al. | 701/50 |
| 6,589,007 | B2 * | 7/2003 | Burton | 414/724 |
| 6,598,391 | B2 * | 7/2003 | Lunzman et al. | 60/327 |
| 6,666,125 | B2 * | 12/2003 | Gunzenhauser | 91/172 |
| 6,820,355 | B2 * | 11/2004 | Yoshino et al. | 37/348 |
| 7,093,383 | B2 * | 8/2006 | Mennen et al. | 37/348 |
| 7,289,896 | B2 * | 10/2007 | Ikari | 701/50 |
| 7,392,125 | B2 * | 6/2008 | Ikari | 701/50 |
| 7,610,136 | B2 * | 10/2009 | Okamura et al. | 701/50 |
| 7,630,793 | B2 * | 12/2009 | Thomas et al. | 700/275 |
| 7,748,147 | B2 * | 7/2010 | Schoenmaker et al. | 37/348 |
| 7,752,778 | B2 * | 7/2010 | Schoenmaker et al. | 37/348 |
| 7,752,779 | B2 * | 7/2010 | Schoenmaker et al. | 37/348 |
| 7,797,860 | B2 * | 9/2010 | Schoenmaker et al. | 37/348 |
| 7,831,352 | B2 * | 11/2010 | Laumer et al. | 701/36 |
| 7,894,962 | B2 * | 2/2011 | Sahlin et al. | 701/50 |
| 8,000,862 | B2 * | 8/2011 | Morinaga et al. | 701/50 |
| 8,065,060 | B2 * | 11/2011 | Danko | 701/50 |
| 8,069,592 | B2 * | 12/2011 | Ellett | 37/406 |
| 8,082,083 | B2 * | 12/2011 | Pirri et al. | 701/50 |
| 8,195,367 | B2 * | 6/2012 | Kim et al. | 701/50 |
| 8,200,398 | B2 * | 6/2012 | Sahlin et al. | 701/50 |
| 8,204,653 | B2 * | 6/2012 | Sahlin et al. | 701/50 |
| 8,336,305 | B2 * | 12/2012 | Matsuura et al. | 60/419 |
| 8,340,875 | B1 * | 12/2012 | Shatters et al. | 701/50 |
| 8,352,129 | B2 * | 1/2013 | Yuan et al. | 701/50 |
| 8,386,133 | B2 * | 2/2013 | Sahlin et al. | 701/50 |
| 2004/0045289 | A1 * | 3/2004 | Ikeda et al. | 60/469 |
| 2005/0177292 | A1 | 8/2005 | Okamura et al. | |
| 2005/0203691 | A1 * | 9/2005 | Kim | 701/50 |
| 2007/0168100 | A1 * | 7/2007 | Danko | 701/50 |
| 2009/0320461 | A1 * | 12/2009 | Morinaga et al. | 60/431 |
| 2011/0153091 | A1 * | 6/2011 | Nicholson et al. | 700/279 |

FOREIGN PATENT DOCUMENTS

| | | | |
|---|---|---|---|
| CN | 1655076 | A | 8/2005 |
| JP | S64-21201 | A | 1/1989 |
| JP | H03-89004 | A | 4/1991 |
| JP | H04-353130 | A | 12/1992 |
| JP | 2005-256595 | A | 9/2005 |

OTHER PUBLICATIONS

Office Action issued Jul. 25, 2013 in Chinese patent application No. 201080010901.9, including English translation, 9 pages.

Office Action issued Apr. 4, 2014 in corresponding Chinese Patent Application No. 201080010901.9, including English translation, 10 pages.

* cited by examiner

CONSTRUCTION MACHINE, METHOD FOR CONTROLLING CONSTRUCTION MACHINE, AND PROGRAM FOR CAUSING COMPUTER TO EXECUTE THE METHOD

CROSS REFERENCE TO RELATED APPLICATIONS

This application claims priority to Application No. PCT/JP2010/053605 filed on Mar. 5, 2010, which application claims priority to Japanese Application No. 2009-053941, filed on Mar. 6, 2009. The entire contents of the above applications are incorporated herein by reference in their entireties.

TECHNICAL FIELD

The present invention relates to a construction machine, a method for controlling the construction machine, and a program for causing a computer to execute the method.

BACKGROUND ART

A construction machine such as a hydraulic excavator carries out various types of works by operating a working equipment including an arm and a boom. In such a construction machine, because the boom has a large inertia when being rapidly started or stopped, a phenomenon that a front side or a back side of the undercarriage floats as a reaction to a motion of the boom (a floating motion of an undercarriage) occurs.

Accordingly, for rapidly starting or stopping the boom, there has been proposed a typical technique including a function to suppress the floating motion of the undercarriage by correcting a motion target value of the boom corresponding to an operation of a lever and regulating a change ratio of a motion speed of the boom to move the boom slowly (see, for instance, Patent Literature 1).

In the technique of Patent Literature 1, for instance, while vibration conditions to be generated in the construction machine in response to the motion of the boom by operating the lever are expectably set as vibration models, the motion target value of the boom corresponding to the operation of the lever is corrected by an inverse operation for cancelling the expected vibrations.

CITATION LIST

Patent Literature

Patent Literature 1 JP-A-2005-256595

SUMMARY OF THE INVENTION

Problem to be Solved by the Invention

In the technique of Patent Literature 1, for instance, for scraping topsoil on the ground flat, a lever for a boom is moved to a position of lifting the boom and, simultaneously, a lever for an arm is moved to a position of scrape (retracting the arm), thereby moving a blade tip of a bucket substantially horizontally. However, the following disadvantages arise.

In the operation of scraping topsoil on the ground flat, an operator performs the operation while adjusting a speed ratio of the boom to the arm. However, when a floating suppression function works only on the boom, the speed ratio of the boom to the arm is changed. Accordingly, even with the same lever operation as that in a typical construction machine in the operation of scraping topsoil on the ground flat, a locus of the blade tip of the bucket becomes misaligned with that in the typical construction machine, thereby lowering operability.

An object of the invention is to provide a construction machine capable of improving operability of a working equipment while suppressing a floating motion of the undercarriage in response to the motion of the boom, a method for controlling the construction machine and a program for causing a computer to execute the method.

Means for Solving the Problems

According to a first aspect of the invention, a construction machine includes: an undercarriage; an upper revolving body; a working equipment provided with a boom and an arm, the working equipment being provided on the upper revolving body; a floating motion suppressing unit that suppresses a floating motion of the undercarriage corresponding to a motion of the boom; and a controller that controls the working equipment, in which power to the working equipment is distributed and fed to a boom driving device that moves the boom and an arm driving device that moves the arm, and the controller includes: manipulating signal input unit including a target value computing unit that generates a motion target value of the boom based on a manipulating signal inputted by a boom manipulating unit that manipulates the boom; a target value correcting unit that corrects the motion target value; and a command signal output unit that outputs a command signal to the boom driving device based on the corrected motion target value, and the target value correcting unit includes: a motion information acquiring unit that acquires motion information on a motion of the arm; a maximum value determining unit that determines based on the motion information a maximum correction value for reducing suppression of a floating motion by the floating motion suppressing unit as the motion of the arm becomes faster; and a correction value regulating unit that corrects the motion target value based on the maximum correction value.

Here, the floating motion suppressing unit is not limited to the technique disclosed in Patent Literature 1, as long as the floating motion suppressing unit has a floating motion suppressing function to suppress a floating motion of the undercarriage as a reaction to the motion of the boom by slowly moving the boom for a rapid start or rapid stop of the boom.

The above-described target value computing unit does not necessarily convert the manipulating signal by a method such as amplification or modulation, but encompasses a target value computing unit that directly provides the manipulating signal without conversion, where the target value computing unit does not substantially function.

In a second aspect of the invention, the construction machine includes a speed sensor that detects a motion speed of the arm, and the motion information acquiring unit acquires the motion speed detected by the speed sensor as the motion information.

In a third aspect of the invention, the construction machine includes a displacement sensor that detects a displacement of an arm manipulating lever that manipulates the arm, in which the motion information acquiring unit includes a motion information generator that generates the motion information based on the displacement detected by the displacement sensor.

In a fourth aspect of the invention, the construction machine includes: a boom actuator as an output unit of the boom driving device and an arm actuator as an output unit of the arm driving device, the boom actuator and the arm actuator being driven by fluid pressure of hydraulic fluid to be fed; and a pressure sensor that detects the fluid pressure of the hydraulic fluid fed to the boom actuator and the arm actuator, in which the motion information acquiring unit includes a motion information generator that generates the motion information based on the fluid pressure detected by the pressure sensor.

A method according to a fifth aspect of the invention is based on development of the construction machine according to the first aspect of the invention.

Specifically, a method for controlling a construction machine includes: an undercarriage; an upper revolving body; a working equipment provided with a boom and an arm, the working equipment being provided on the upper revolving body; a floating motion suppressing unit that suppresses a floating motion of the undercarriage corresponding to a motion of the boom; and a controller that controls the working equipment, in which power to the working equipment is distributed and fed to a boom driving device that moves the boom and an arm driving device that moves the arm, and the method is performed by the controller, the method including: generating a motion target value of the boom based on a manipulating signal inputted by a boom manipulating unit that manipulates the boom; acquiring motion information on a motion of the arm; determining based on the motion information a maximum correction value for reducing suppression of a floating motion by the floating motion suppressing unit as the motion of the arm becomes faster; and correcting the motion target value based on the maximum correction value.

A sixth aspect of the invention relates to a computer-executable program of causing a controller of a construction machine to execute the method according to the fifth aspect of the invention.

According to the first aspect of the invention, the maximum correction value for reducing suppression of the floating motion by the floating motion suppressing unit is determined in accordance with the motion conditions of the arm, and the motion target value derived from the manipulating signal is corrected based on the determined maximum correction value. With this arrangement, by determining a relatively small maximum acceleration value (hereinafter referred to as a first maximum acceleration value) as the maximum correction value when the boom is singly moved (i.e., when the motion speed of the arm is substantially "0" (zero)), or determining a maximum acceleration value higher than the first maximum acceleration value as the maximum correction value (hereinafter referred to as a second maximum acceleration value) when both of the boom and the arm are moved (i.e., when the motion speed of the min is relatively high), the boom can be moved as follows.

When the boom is singly moved, for rapidly starting or stopping the boom, the boom can be slowly moved since acceleration of the boom is regulated by the relatively small first maximum acceleration value. In other words, the floating motion of the undercarriage as a reaction to the motion of the boom can be sufficiently suppressed.

When both of the boom and the arm are moved, for rapidly starting or stopping the boom, acceleration regulation for the boom is suppressed more than the above case since acceleration of the boom is regulated by the relatively large second maximum acceleration value, so that the boom can be quickly moved. In other words, such a quick motion of the boom has priority over the advantages of suppressing the floating motion of the undercarriage as a reaction to the motion of the boom.

As described above, the function to suppress the floating motion can vary in levels in accordance with motion conditions of the arm. Accordingly, in the operation of scraping topsoil on the ground flat by moving both of the boom and the arm, by weakly operating the function to suppress the floating motion to quickly move the boom, a locus of the blade tip of the bucket can be kept substantially horizontal and operability of the working equipment can be enhanced.

When both of the boom and the arm are moved in the operation of scraping topsoil on the ground flat, although the acceleration regulation for the boom is suppressed as described above, power to the working equipment (e.g., a flow rate and pressure of the hydraulic fluid) is distributed and fed to the boom driving device and the arm driving device. In other words, even when a command exceeding the maximum acceleration for moving the boom by suppressing the acceleration regulation for the boom is outputted to the boom driving device, since the hydraulic fluid fed to the boom driving device is regulated by an amount of power fed to the arm driving device, the boom moves only at an acceleration lower than the maximum acceleration by the amount of the power fed to the arm driving device. Accordingly, the floating motion of the undercarriage does not occur.

According to the second aspect of the invention, since the motion speed of the arm is actually detected, the maximum correction value can be appropriately determined in accordance with the detected actual motion speed, and the levels of the function to suppress the floating motion can be appropriately determined.

According to the third aspect of the invention, since the motion information of the arm is generated and acquired based on the displacement of the aim manipulating lever, the maximum correction value can be appropriately determined in accordance with the motion conditions of the arm, and the levels of the function to suppress the floating motion can be appropriately determined.

In this arrangement, a common displacement sensor can be used for the arm manipulating lever and the boom manipulating lever, the speed sensor and the like in the above aspect of the invention are not additionally required, so that a structure can be simplified.

According to the fourth aspect of the invention, since the motion information of the arm is generated and acquired based on pressure of the hydraulic fluid fed to each of the boom actuator and the arm actuator, the maximum correction value can be appropriately determined in accordance with the motion conditions of the arm, and the levels of the function to suppress the floating motion can be appropriately determined.

According to the fifth aspect of the invention, the same action and advantages as those in the first aspect of the invention can also be obtained.

According to the sixth aspect of the invention, the method according to the fifth aspect of the invention can be carried out only by installing a program on a controller of a general construction machine provided with the controller, so that the invention can be significantly popularized.

DESCRIPTION OF EXEMPLARY EMBODIMENTS

Exemplary embodiments of the invention will be described below with reference to the drawings.

First Exemplary Embodiment

(1) Overall Structure

Figure 1:
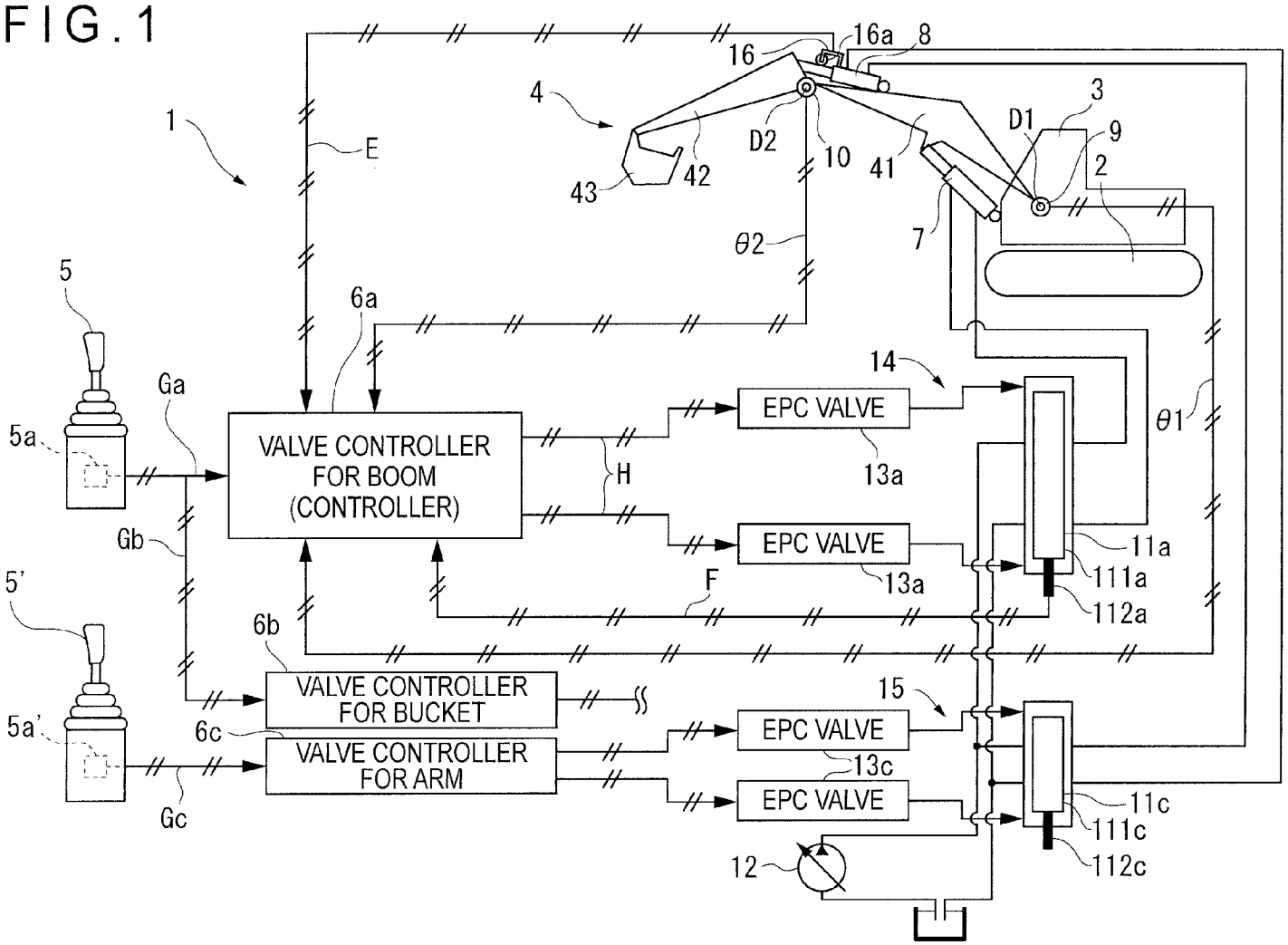
FIG. 1 is a schematic diagram showing a construction machine according to a first exemplary embodiment of the invention.

FIG. 1 is a schematic diagram showing a hydraulic excavator (construction machine) 1 according to a first embodiment of the invention.

In FIG. 1, the hydraulic excavator 1 includes an undercarriage 2, an upper revolving body 3 provided above the undercarriage 2 in a revolvable manner, and a working equipment 4 attached to the upper revolving body 3.

The undercarriage 2 employed in this exemplary embodiment is a crawler-type undercarriage provided with crawler belts. However, a wheel-type undercarriage provided with tires or other appropriate undercarriages are applicable.

The upper revolving body 3 is provided with working equipment levers 5 and 5', a travel lever and the like, by which a motion of the working equipment 4, a revolving motion of the upper revolving body 3 and a travel motion of the undercarriage 2 can be controlled.

In FIG. 1, the working equipment levers 5 and 5' are shown independently from the upper revolving body 3 for convenience of descriptions. A portion of a hydraulic circuit and valve controllers 6*a*, 6*b* and 6*c*, which are mounted on the upper revolving body 3, are also shown independently from the upper revolving body 3.

The working equipment 4 includes a boom 41 manipulated by the working equipment lever (boom manipulating unit) 5, an arm 42 manipulated by the working equipment lever (arm manipulating unit) 5' and a bucket 43 attached to a tip of the arm 42.

The boom 41 is rotated around a support point D1 by a hydraulic cylinder 7.

The arm 42 is rotated around a support point D2 by a hydraulic cylinder 8 on the boom 41.

The bucket 43 is rotated by the hydraulic cylinder on the arm 42 when the working equipment lever 5 is manipulated in different directions.

In addition to the bucket 43, any attachment such as a grapple and a hand may be used.

Angle sensors 9 and 10 such as a rotary encoder and a potentiometer are respectively provided at the support point D1 of the boom 41 and the support point D2 of the arm 42. The angle sensor 9 detects a joint angle θ1 of the boom 41 relative to the upper revolving body 3. The angle sensor 10 detects a joint angle θ2 of the arm 42 relative to the boom 41. The joint angles θ1 and θ2 are outputted as an angle signal to the valve controller (controller) 6*a*.

The hydraulic cylinders 7 and 8 are respectively connected to separate main valves 11*a* and 11*c*. The main valves 11*a* and 11*c* are parallely connected to a common hydraulic pump 12.

In an actual hydraulic circuit, in addition to the hydraulic cylinders 7 and 8, a hydraulic cylinder for manipulating the bucket 43, a hydraulic motor for revolving the upper revolving body 3 and a hydraulic motor for causing the undercarriage 2 to travel are respectively connected to separate main valves. These main valves are parallely connected to the common hydraulic pump 12. However, for convenience of descriptions, FIG. 1 shows that only the main valves 11*a* and 11*c* are parallely connected to the hydraulic pump 12.

Hydraulic fluid discharged from the hydraulic pump 12 is distributed to the main valves 11*a* and 11*c*. Spools 111*a* and 111*c* of the main valves 11*a* and 11*c* are moved by EPC valves 13*a* and 13*c* as a pair of proportional solenoid valves, whereby a flow rate of the hydraulic fluid is adjusted and fed to the hydraulic cylinders 7 and 8.

The above-described hydraulic cylinder 7 (boom actuator), the main valve 11*a* and the EPC valve 13*a* provide a boom driving device 14 according to this exemplary embodiment. The hydraulic cylinder 8 (arm actuator), the main valve 11*c* and the EPC valve 13*c* provide an arm driving device 15 according to this exemplary embodiment.

The hydraulic cylinder 8 is provided with a speed sensor 16 for detecting a motion speed of the hydraulic cylinder 8 with the hydraulic fluid.

For instance, as shown in FIG. 1, the speed sensor 16 is provided with a roller 16*a* in contact with a cylinder rod of the hydraulic cylinder 8. The speed sensor 16 measures a rotation speed of the roller 16*a* in response to a motion of the cylinder rod and outputs an electrical signal corresponding to the rotation speed of the roller 16*a* to the valve controller 6*a*.

Since the arm 42 is moved by the hydraulic cylinder 8 causing the roller 16*a* to rotate, the speed sensor 16 detects a motion speed E of the arm 42.

Position sensors 112*a* and 112*c* for detecting positions of the spools 111*a* and 111*c* are respectively provided in the main valves 11*a* and 11*c*. The position sensors 112*a* and 112*c* output the positions of the spool 111*a* and 111*c* as a position signal F to the valve controllers 6*a* and 6*c*.

The working equipment levers 5 and 5' are provided with inclination angle sensors (displacement sensors) 5*a* and 5*a*' such as a potentiometer, a PPC pressure sensor and a torque sensor with use of an electrostatic capacity or a laser. Lever manipulating signals Ga and Gc having a one-to-one relationship with inclination angles of working equipment levers 5 and 5' are outputted from the inclination angle sensors 5*a* and 5*a*' to the valve controllers 6*a* and 6*c*.

When the working equipment lever 5 is at the neutral position, the outputted lever manipulating signal Ga is "0" (zero), indicating that a speed of the boom 41 is "0" (zero). When the working equipment lever 5 is inclined forward, the boom 41 moves downward at a speed corresponding to the inclination angle of the working equipment lever 5. When the working equipment lever 5 is inclined backward, the boom 41 moves upward at a speed corresponding to the inclination angle of the working equipment lever 5. The controls as described above are provided by the valve controller 6*a* described hereinafter.

The valve controller 6*a* has a function to move the boom 41 according to the lever manipulating signal Ga from the working equipment lever 5 and also to suppress vibrations when the boom 41 is started or stopped. The valve controller 6*a* is provided by a microcomputer and the like, and is typically incorporated as a portion of a governor pump controller mounted for controlling an engine of the hydraulic excavator 1 and for controlling a hydraulic pump thereof. However, in this exemplary embodiment, the valve controller 6*a* is shown as an independent component for convenience of descriptions.

Also, a valve controller 6*b* for the bucket 43 to which a manipulating signal Gb is inputted and a valve controller 6*c* for the arm 42 to which a manipulating signal Gc is inputted have substantially the same functions and configurations respectively, but herein description is made with reference to the valve controller 6*a* for the boom 41 as a representative, and descriptions of the valve controllers 6*b* and 6*c* are omitted herefrom.

(2) Structure of Valve Controller 6*a*

Figure 2:
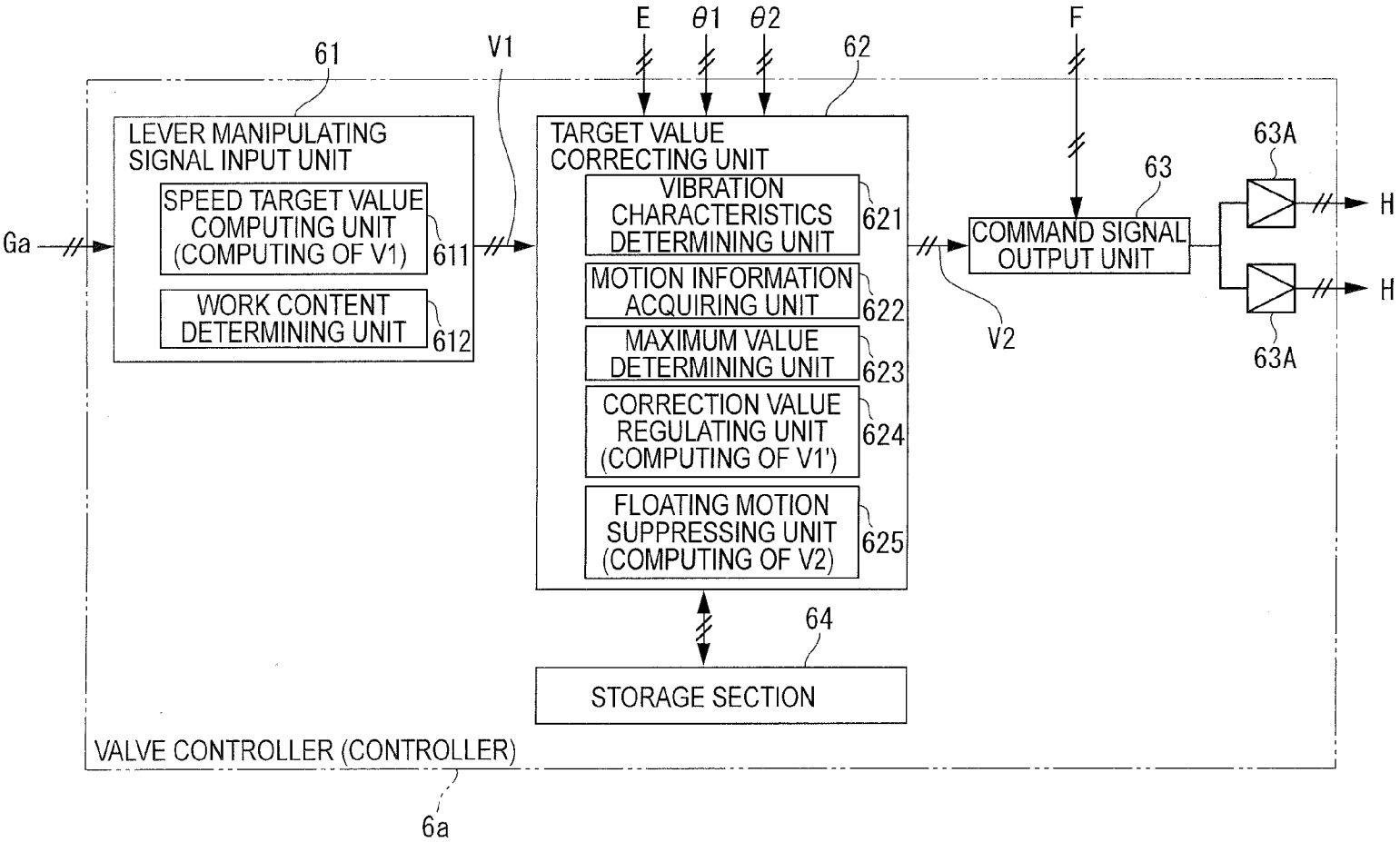
FIG. 2 is a block diagram showing a valve controller.

FIG. 2 is a block diagram showing the valve controller 6*a*.

Specifically, as shown in FIG. 2, the valve controller 6*a* includes a lever manipulating signal input unit 61 to which the lever manipulating signal Ga (voltage signal) from the working equipment lever 5 is inputted, a target value correcting unit 62 to which a speed target value (motion target value) V1 from the lever manipulating signal input unit 61 is inputted, a command signal output unit 63 to which a corrected speed target value V2 from the target value correcting unit 62 is inputted, and a storage section 64 including a RAM, a ROM, or the like.

The lever manipulating signal input unit 61, the target value correcting unit 62, and the command signal output unit 63 are computer programs (software).

(2-1) Structure of Lever Manipulating Signal Input Unit 61

The lever manipulating signal input unit 61 (manipulating signal input unit) includes a speed target value computing unit 611 and a work content determining unit 612.

The speed target value computing unit 611 (target value computing unit) computes the speed target value V1 for the boom 41 based on the lever manipulating signal Ga from the working equipment lever 5 which is sampled at every predetermined time Δt.

The work content determining unit 612 determines a work at a constant speed and a rolling compaction work among works performed with the boom 41, and has a function not to provide acceleration regulating process and floating motion suppressing process (described hereinafter) during the works specified above. The function will be described hereinafter.

(2-2) Structure of Target Value Correcting Unit 62

The target value correcting unit 62 has the most characteristic structure in this exemplary embodiment, and includes a vibration characteristics determining unit 621, a motion information acquiring unit 622, a maximum value determining unit 623, a correction value regulating unit 624 and a floating motion suppressing unit 625, which are also provided by computer programs (software).

The vibration characteristics determining unit 621 has a function to determine a frequency ω and a damping coefficient ζ corresponding to postures of the boom 41 and arm 42 in response to input of the joint angles θ1 and θ2. The joint angles θ1 and θ2 vary within a predetermined range in conjunction with changes in postures of the boom 41 and arm 42, but the frequency ω and the damping coefficient ζ corresponding to the joint angles θ1 and θ2 are previously calculated for an actual vehicle and are stored in the storage section 64.

Accordingly, when the joint angles θ1 and θ2 are inputted, the frequency ω and the damping coefficient ζ corresponding to the joint angles θ1 and θ2 are immediately retrieved from the storage section 64, and are used by the floating motion suppressing unit 625.

The motion information acquiring unit 622 inputs the electrical signal outputted from the speed sensor 16 at a predetermined timing and acquires the motion speed E (motion information) of the arm 42 based on the inputted electrical signal.

The maximum value determining unit 623 has a function to determine a maximum acceleration value α as a maximum correction value of the boom 41 corresponding to the motion speed E of the arm 42. Here, the maximum acceleration value α corresponding to the motion speed E of the arm 42 is previously calculated for an actual vehicle and is stored in the storage section 64.

For instance, a table in which the motion speed E of the arm 42 and the maximum acceleration value α are associated with each other is stored in the storage section 64.

Accordingly, when the motion speed E is inputted, the maximum acceleration value α corresponding to the motion speed E is immediately retrieved from the storage section 64, and is used by the correction value regulating unit 624.

Figure 3:
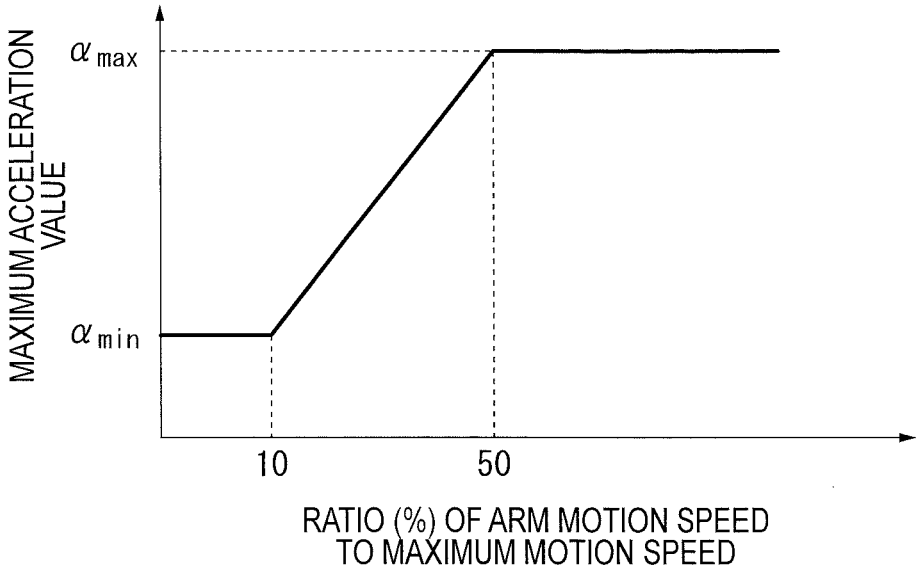
FIG. 3 is an illustration showing an example of a maximum acceleration value.

FIG. 3 is an illustration showing an example of the maximum acceleration value α.

In FIG. 3, the vertical axis shows the maximum acceleration value. The horizontal axis shows a ratio (%) of the motion speed of the arm 42 to the maximum motion speed for moving the arm 42.

As shown in FIG. 3, for instance, when the motion speed of the arm 42 is 10% or less, the maximum acceleration value α is set at a relatively small maximum acceleration value αmin.

The maximum acceleration value αmin is defined as a maximum acceleration value in such a range that a front side or a back side of the undercarriage 2 does not float (no floating motion occurs) as a reaction to the motion of the boom 41 when the boom 41 is moved in an actual vehicle.

Moreover, as shown in FIG. 3, the maximum acceleration value αmin is set so as to increase at a predetermined ratio from the maximum acceleration value αmin when the motion speed of the arm 42 is in a range of 10% to 50%, and is set at a maximum acceleration value αmax when the motion speed of the arm 42 is 50% or more.

The maximum acceleration value αmax is set at a value equivalent to or exceeding the maximum acceleration for moving the boom 41.

Figure 4A:
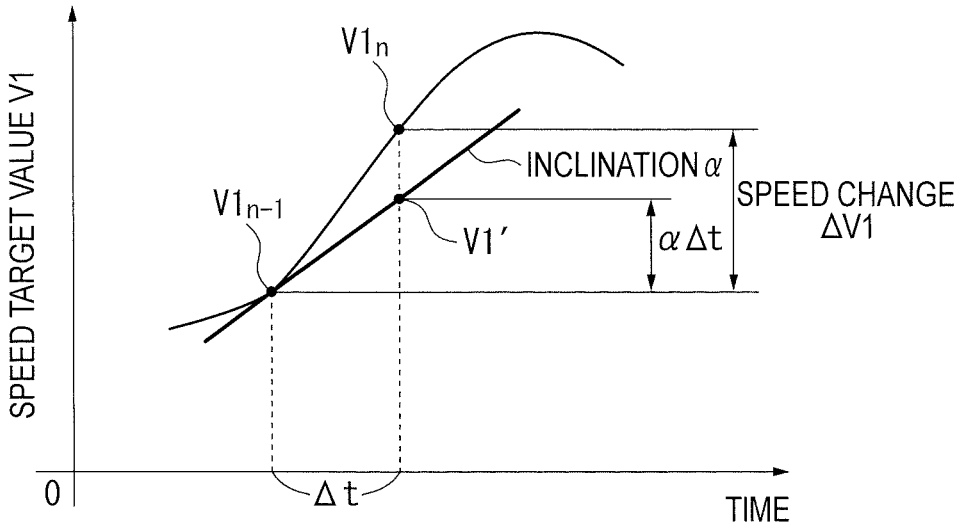
FIG. 4A is an illustration for explaining acceleration restricting process.
Figure 4B:
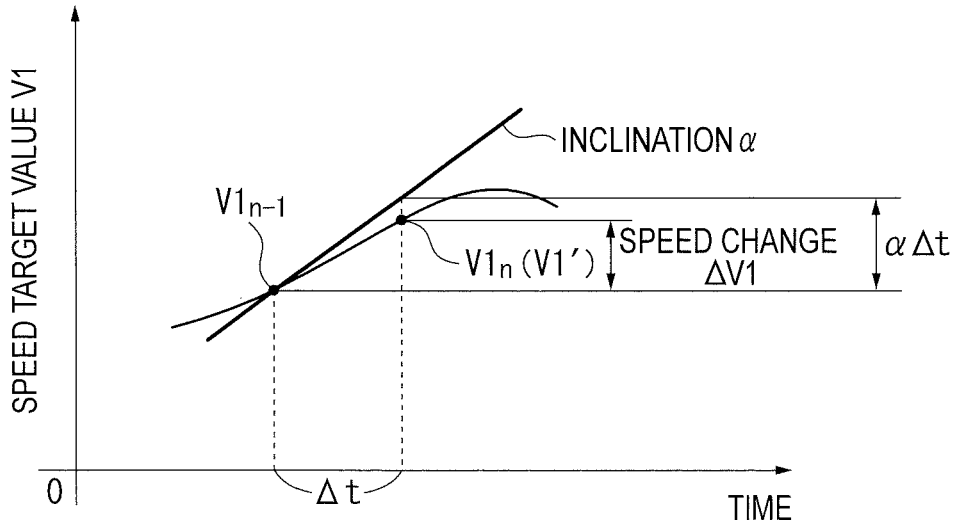
FIG. 4B is another illustration for explaining acceleration restricting process.

FIGS. 4A and 4B each are an illustration for explaining acceleration regulating process.

The correction value regulating unit 624 has a function to apply the acceleration regulating process (correction value regulating process) on the speed target value V1 obtained from the lever manipulating signal Ga, and to correct the speed target value V1 to a speed target value V1' so that the acceleration of the boom 41 does not exceed the maximum acceleration value α determined by the maximum value determining unit 623.

For instance, as shown in FIGS. 4A and 4B, the correction value regulating unit 624 corrects the speed target value V1 to the speed target value V1' by applying the acceleration regulating process.

In FIGS. 4A and 4B, as the speed target value V1, a speed target value for the acceleration regulating process is defined as $V1_n$ and a speed target value obtained Δt hour(s) before the speed target value $V1_n$ is defined as $V1_{n-1}$.

Specifically, as shown in FIG. 4A, when a speed change ΔV1 of the speed target value $V1_n$ is larger than αΔt obtained by multiplying the maximum acceleration value α determined by the maximum value determining unit 623 by Δt, the correction value regulating unit 624 regulates the speed change (acceleration) and corrects the speed target value $V1_n$ to the speed target value V1' so that the speed change from the speed target value $V1_{n-1}$ becomes αΔt.

As shown in FIG. 4B, on the contrary to the above, when the speed change ΔV1 is αΔt or less, the correction value regulating unit 624 defines the speed target value $V1_n$ as the speed target value V1' without regulating the acceleration.

The floating motion suppressing unit 625 has a function to apply the floating motion suppressing process on the corrected speed target value V1' and to correct the speed target value V1' to the speed target value V2 so that the boom 41 is not eventually vibrated.

In other words, the floating motion suppressing unit 625 corrects the speed target value V1' to the speed target value V2 by estimating vibration conditions to be generated on the hydraulic excavator 1 including the working equipment 4 with use of the vibration models and executing the inverse operation such as cancellation of the estimated vibration.

For instance, the floating motion suppressing unit 625 corrects the speed target value V1' corrected by the correction value regulating unit 624 at every Δt hour(s) to the speed target value V2 according to the following formula (1) with use of the frequency ω and the damping coefficient ζ by determined by the vibration characteristics determining unit 621 to postures of the working equipment 4 at every Δt hour (s).

S represents a Laplace operator and $\omega_0$ is a constant separately determined Formula 1

$$V2 = \frac{\omega_0^2}{\omega^2} \times V1' + \frac{2\omega_0(\zeta\omega - \omega_0)}{\omega^2} \times \left(\frac{\omega_0}{S + \omega_0}\right) V1' + \frac{\omega^2 + \omega_0^2 - 2\zeta\omega\omega_0}{\omega^2} \times \left(\frac{\omega_0}{S + \omega_0}\right)^2 V1' \quad (1)$$

Figure 5A:
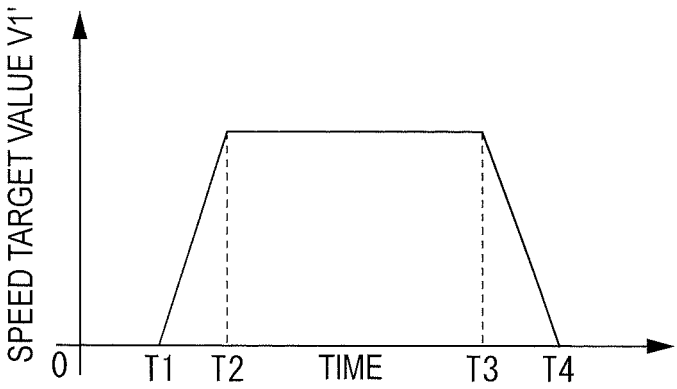
FIG. 5A is an illustration for explaining floating motion suppressing process.
Figure 5B:
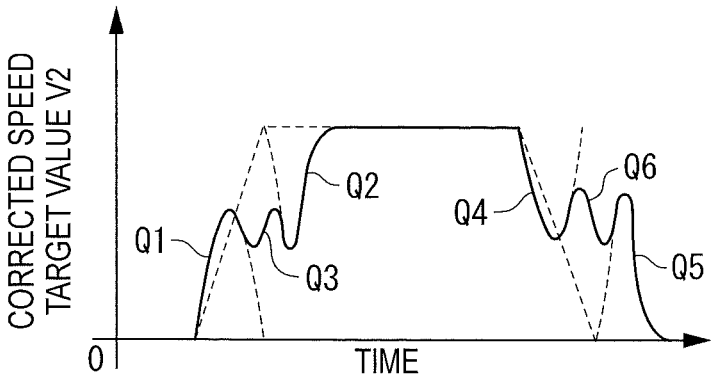
FIG. 5B is another illustration for explaining the floating motion suppressing process.
Figure 5C:
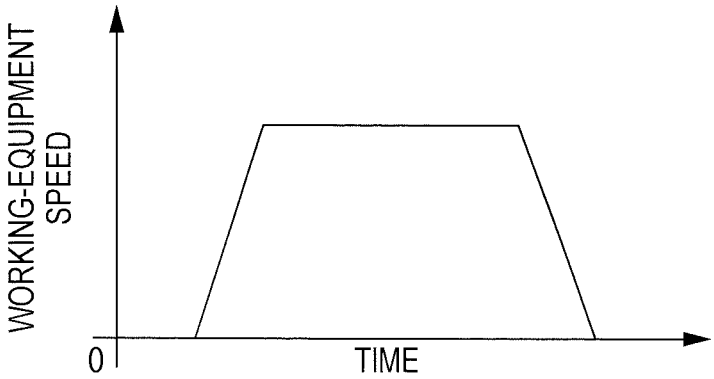
FIG. 5C is still another illustration for explaining the floating motion suppressing process.

FIGS. 5A, 5B and 5C each are an illustration for explaining floating motion suppressing process.

FIG. 5A shows the speed target value V1' after the correction value regulating process is applied on the speed target value V1 obtained by the speed target value computing unit 611, when the working equipment lever 5 is inclined from the neutral position (time T1), maintained in the inclined state for a predetermined time (time T2-T3) and returned to the neutral position (time T4).

When the working equipment lever 5 is inclined from the neutral position in order to drive the boom 41, the floating motion suppressing process by the floating motion suppressing unit 625 corrects the speed target value V1' to the speed target value V2 including curves Q1, Q2 and Q3 as shown in FIGS. 5A and 5B.

Specifically, in the portion corresponding to the curve Q1, which is formed by being triggered with time T1, the speed target value V2 is corrected so that the curve formed by the speed target value V2 bulges in such a direction that the speed target value V2 becomes larger than the speed target value V1'. In the portion corresponding to the curve Q3, which is the portion after the peak of the curve Q1 to the point corresponding to time T2, the speed target value V2 is corrected to follow the increase in the speed target value V1' as a whole while being smaller than the speed target value V1'. In the portion corresponding to the curve Q2, which is formed by being triggered with time T2 when the speed target value V1' reaches a maximum value, the speed target value V2 is corrected so that the curve formed by the speed target value V2 bulges in such a direction that the speed target value V2 becomes smaller than the speed target value V1', and reaches the maximum value at a timing later than time T2 when the speed target value V1' reaches the maximum value.

On the other hand, when the working equipment lever 5 is returned to the neutral position to stop the drive of the boom 41, the same operation is carried out to correct the speed target value V1' as the speed target value V2 including curves Q4, Q5 and Q6.

Specifically, in the portion corresponding to the curve Q4, which is formed by being triggered with time T3, the speed target value V2 is corrected so that the curve formed by the speed target value V2 bulges in such a direction that the speed target value V2 becomes smaller than the speed target value V1'. In the portion corresponding to the curve Q6, which is the portion after the peak of the curve Q4 to the point corresponding to time T4, the speed target value V2 is corrected to follow the decrease in the speed target value V1' as a whole while being larger than the speed target value V1. In the portion corresponding to the curve Q6, which is formed by being triggered with time T4 when the speed target value V1' reaches 0 (zero), the speed target value V2 is corrected so that the curve formed by the speed target value V2 bulges in such a direction that the speed target value V2 becomes larger than the speed target value V1', and the working equipment 4 is stopped at a timing later than time T2 when the speed target value V1' reaches 0 (zero).

At this time, the boom 41 starts its movement in accordance with the movement of the boom driving device 14. In this step, the vibrations due to such factors as compression of hydraulic fluid or elasticity of piping are applied to the section from the boom driving device 14 to the boom 41, but the vibration components are just inverse to those used in correction of the speed target value V1' to the speed target value V2. Because of this feature, as shown in FIG. 5C, the boom 41 moves without vibrations.

Description of this exemplary embodiment assumes a case where the speed target value V1' has a signal waveform like a trapezoid. However, when an inclination of the working equipment lever 5 is once stopped and then the inclination thereof is restarted during a period from the time T1 to the time T2, or when inclination of the working equipment lever 5 is once stopped and then the inclination is restarted from the time T3 to the time T4, namely even when a signal waveform for the target speed value V1 exhibits a substantially convex form, correction of the speed target value V1 is made in the same way when inclination of the working equipment lever 5 is once stopped or restarted. The same is also applied to a case when a signal waveform of the speed target value V1' is a step-like one.

(2-3) Structure of Command Signal Output Unit 63

The command signal output unit 63 has a function to generate a command signal (current signal) H to the boom driving device 14 based on the corrected speed target value V2 and output the command signal H via an amplifier 63A to the EPC valve 13*a*. The EPC valve 13*a* moves the spool 111*a* constituting the main valve 11*a* based on this command signal H, and adjusts a feed rate of the hydraulic fluid to the hydraulic cylinder 7.

(3) Action of Valve Controller 6*a* and Structure of Work Content Determining Unit 612

Figure 6:
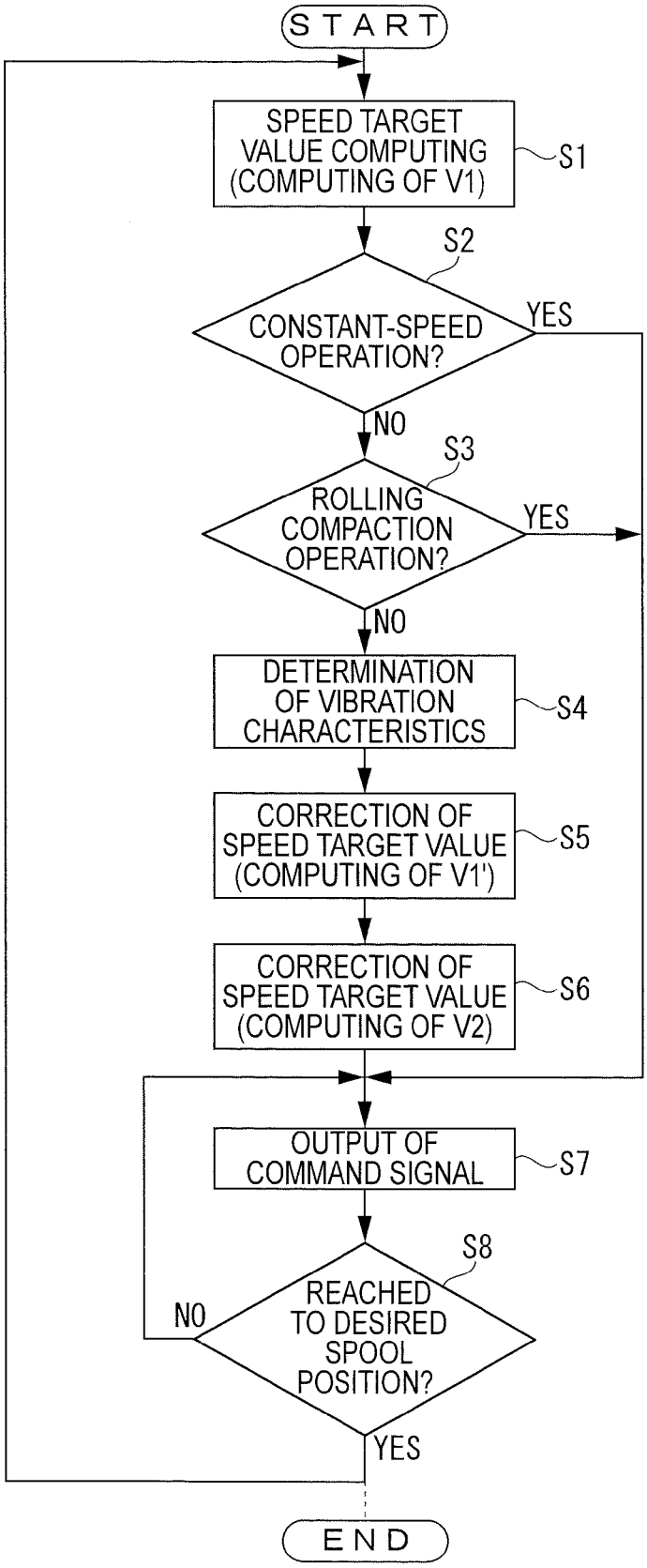
FIG. 6 is a flow chart for explaining a method for controlling a working equipment.

Next, a method for controlling the boom 41 is described also with reference to the flow chart in FIG. 6, and also the work content determining unit 612 is described in detail with reference to FIGS. 7A, 7B and 8.

(a) Step S1: At first, when an operator starts manipulation of the working equipment lever 5, the speed target value computing unit 611 in the lever manipulating signal input unit 61 computes the speed target value V1 based on the lever manipulating signal Ga from the working equipment lever 5.

(b) Step 2: Then, the work content determining unit 612 is actuated and determines whether the operator manipulates the boom 41 at a constant speed or not.

For manipulating the boom 41 at a constant speed, it is required to keep an inclined posture of the working equipment lever 5 at a certain angle, but it is difficult for the operator to maintain the inclined posture of the working equipment lever 5 without changing the inclination angle at all. In other words, even when the operator considers that he or she manipulates the boom 41 at a constant speed, fine vibrations ignorable in actual works occur in the operator's lever manipulation as shown in FIG. 7A, so that the lever manipulating signal Ga is slightly fluctuating.

Figure 7A:
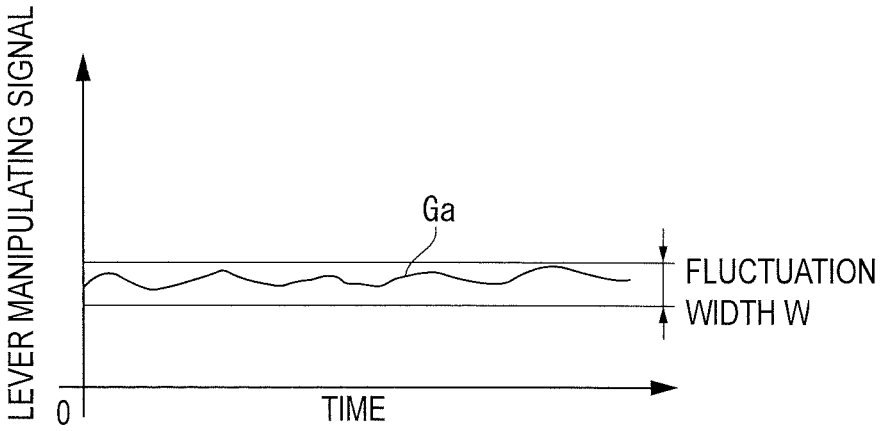
FIG. 7A is an illustration for explaining a constant-speed operation.
Figure 7B:
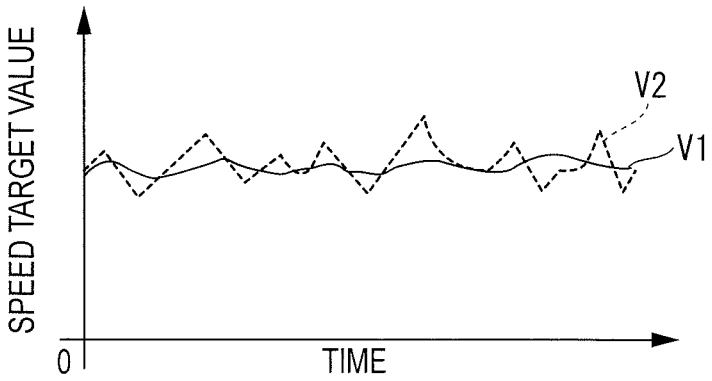
FIG. 7B is another illustration for explaining the constant-speed operation.

It is allowable to obtain the speed target value V1 based on the lever manipulating signal Ga as described above, but when the speed target value V2 is obtained based on the speed target value V1, fluctuation of the speed target value V2 becomes larger as shown in FIG. 7B. Accordingly, the boom 41 precisely moving according to the command signal H based on the speed target value V2 sensitively reacts to fine fluctuations of the working equipment lever 5, which makes it difficult to perform a work at a constant speed.

Further, when width of variation in the speed is small as shown in FIG. 7A, since the vibration of the working equipment 4 is small, there is practically no problem even if the correction is not performed by the floating motion suppressing unit 625.

Accordingly, when fluctuations of the lever manipulating signal Ga is within a predetermined amplitude W, the work content determining unit 612 determines that the current work is being carried out at a constant speed and directly generates the command signal H based on the speed target value V1. With this arrangement, in step S2, when the fluctuation of the lever manipulating signal Ga is over the amplitude W, the work content determining unit 612 determines that the current work is not being performed at a constant speed and enters the step S3. However, when the fluctuation of the lever manipulating signal Ga is within the amplitude W, the work content determining unit 612 determines that the current work is being performed at a constant speed, and skips to the step S7 without carrying out the correction of the speed target value V1 to the speed target value V2.

A constant speed work is often employed when accurate positioning is required by moving the boom 41 at a low speed. In such a case, suppression of sensitive reactions to fine fluctuations of the working equipment lever 5 gives many merits.

(c) Step S3: Also in this step, the work content determining unit 612 is actuated to determine whether the operator is carrying out a rolling compaction work or not.

The rolling compaction work is performed by reciprocally moving the working equipment lever 5 over the neutral position forward and backward in a short cycle where vibrations generated in the boom 41 is positively utilized. Accordingly, during the rolling compaction work as described above, if vibrations of the boom 41 are suppressed by correcting the speed target value V1 to the speed target value V2 by the floating motion suppressing unit 625, it is difficult to smoothly carry out the rolling compaction work compared to typical ones.

Accordingly, in the step S3, when it is determined that the operator is carrying out a rolling compaction work, the work content determining unit 612 skips to step S7 without executing correction of the speed target value V1, and drives the boom driving device 14 according to the command signal H based on the speed target value V1.

Figure 8:
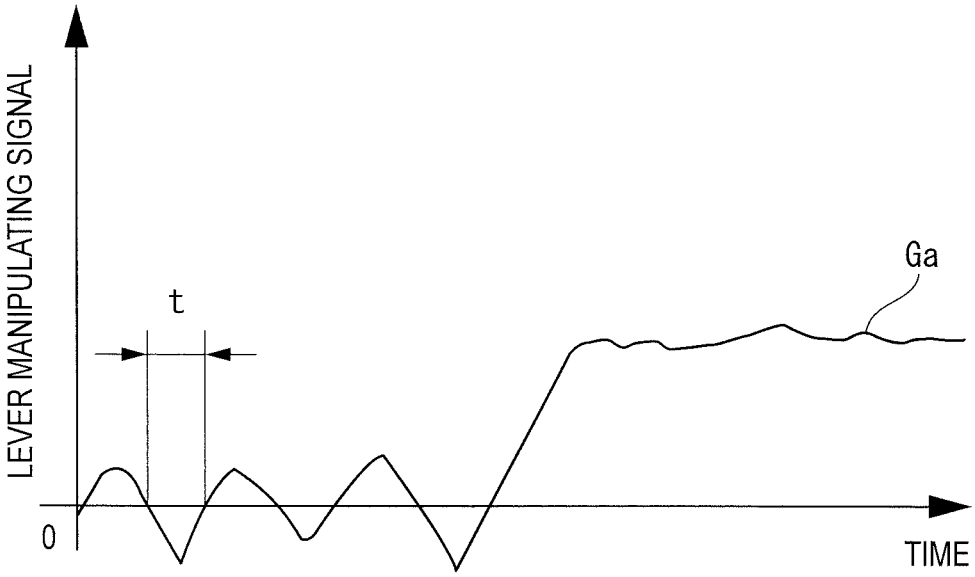
FIG. 8 is an illustration for explaining a rolling compaction operation.

Determination as to whether a rolling compaction work is being carried out or not is performed by detecting a time interval t between time points at which a value of the lever manipulating signal Ga becomes "0" (zero) as shown in FIG. 8. When the time interval t is shorter than a predetermined time interval, it means that the working equipment lever 5 is repeatedly being manipulated over the neutral position, so that it is determined that a rolling compaction work is being carried out.

(d) Step S4: When it is determined in step S2 and step S3 that neither a constant speed work nor a rolling compaction work is being carried out, the vibration characteristics determining unit 621 in the target value correcting unit 62 determines the frequency $\omega$ and damping coefficient $\zeta$ corresponding to the joint angles $\theta$1 and $\theta$2 and stores those in a storage such as a RAM provided in the valve controller 6*a*.

(e) Step S5: Then, the motion information acquiring unit 622, the maximum value determining unit 623 and the correction value regulating unit 624 are actuated and corrects the speed target value V1 to compute the speed target value V1' in the acceleration regulating process.

Figure 9:
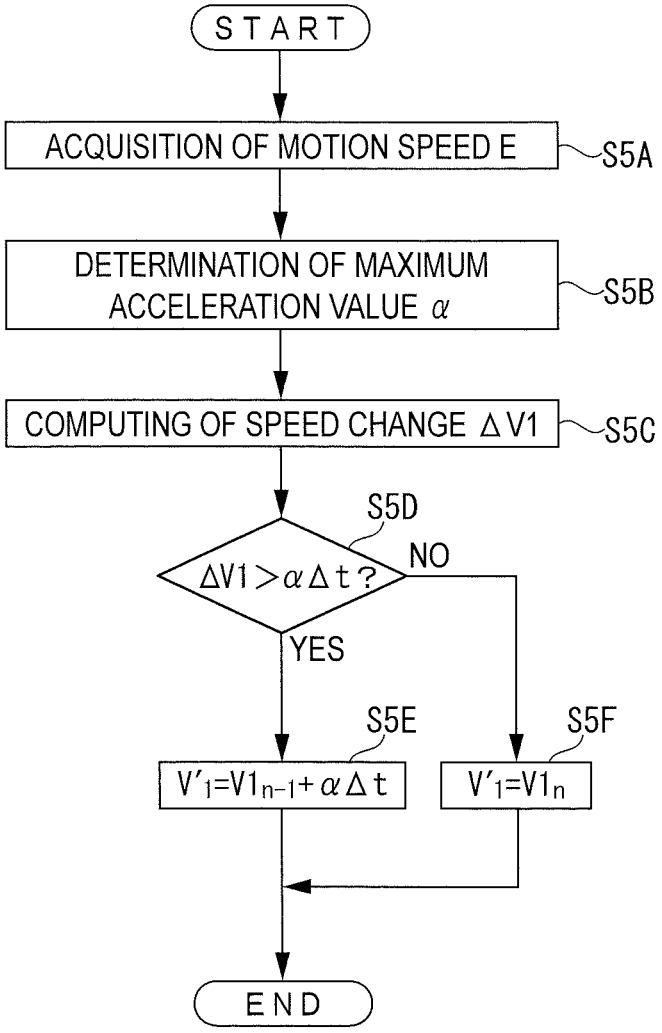
FIG. 9 is a flow chart for explaining acceleration regulating process.

Specifically, such an operation is performed based on the flow chart shown in FIG. 9. The acceleration regulating process will be described below in detail with reference to FIGS. 10A and 10B together with the flow chart in FIG. 9.

Step S5A: At first, the motion information acquiring unit 622 acquires the motion speed E of the arm 42 based on the electrical signal from the speed sensor 16.

Step S5B: Next, the maximum value determining unit 623 determines the maximum acceleration value $\alpha$ corresponding to the motion speed E of the arm 42 from the storage section 64.

For instance, when the boom 41 is singly moved, in other words, when the motion speed E of the arm 42 is 10% or less relative to the maximum motion speed, the maximum value determining unit 623 determines the maximum acceleration value $\alpha$min (FIG. 3) as the maximum acceleration value $\alpha$.

Further, for instance, when both of the boom 41 and the arm 42 are moved, in other words, when the motion speed E of the arm 42 is 50% or more relative to the maximum motion speed, the maximum value determining unit 623 determines the maximum acceleration value $\alpha$max (FIG. 3) as the maximum acceleration value $\alpha$max.

Step S5C: Next, the correction value regulating unit 624 computes the speed change $\Delta$V1 of the speed target value V1$_n$ relative to the speed target value $V1_{n-1}$ obtained Δt hour(s) before the speed target value $V1_n$.

Step S5D: The correction value regulating unit 624 determines whether or not the speed change ΔV1 obtained in the step S5C is larger than αΔt obtained by multiplying the maximum acceleration value α determined in the step S5B by Δt.

Step S5E: When the correction value regulating unit 624 determines in the step S5C that the speed change ΔV1 is larger than αΔt, the correction value regulating unit 624 regulates the speed change (acceleration) and corrects the speed target value $V1_n$ to the speed target value V1' so that the speed change from the speed target value $V1_{n-1}$ becomes αΔt.

Step S5F: On the contrary, when the speed change ΔV1 is αΔt or less in the step SSC, the correction value regulating unit 624 defines the speed target value $V1_n$ as the speed target value V1' without regulating the acceleration.

In other words, although the speed target value $V1_n$ is the speed target value directly obtained from the lever manipulating signal Ga, when the speed change ΔV1 is larger than αΔt, $V1'=V1_{n-1}+\alpha\Delta t$ and, on the contrary, when the speed change ΔV1 is αΔt or less, $V1'=V1_n$.

Figure 10A:
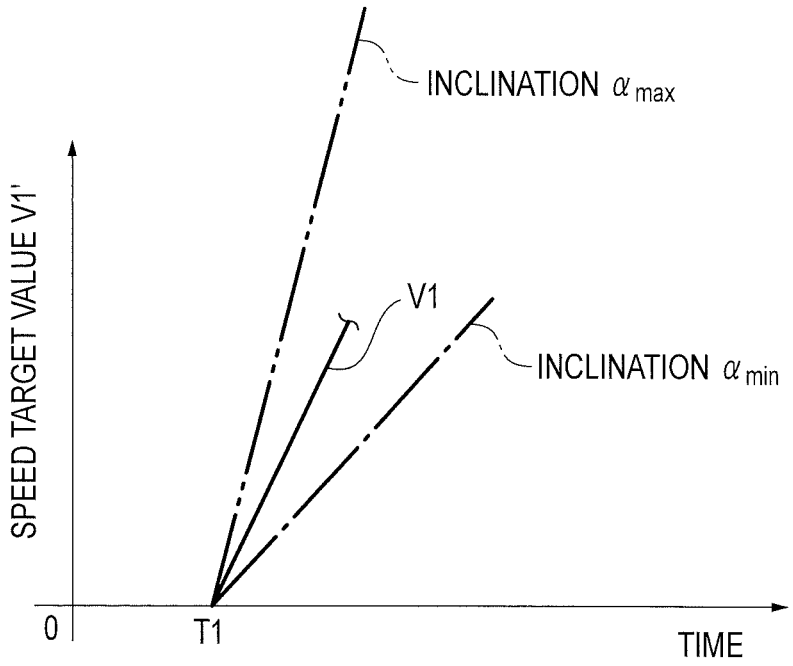
FIG. 10A is an illustration for explaining a speed target value after the acceleration regulating process.

Specifically, as shown in FIG. 10A, the speed target value V1 is corrected to the speed target value V1' by executing the acceleration regulating process in the step S5.

FIG. 10A assumes a case where the working equipment lever 5 is inclined from the neutral position (time T1) and the boom 41 is rapidly started. In FIG. 10A, a solid line represents the speed target value V1 obtained based on the lever manipulating signal Ga. The speed target value V1 is defined as one increasing in proportion to elapsed time. The speed change (inclination) of the speed target value V1 is defined as a value larger than the maximum acceleration value αmin and smaller than the maximum acceleration value αmax.

For instance, when the working equipment lever 5 is inclined but the working equipment lever 5' is not inclined, in other words, when the boom 41 is singly moved, the motion speed E of the arm is 0 (zero) (10% or less relative to the maximum motion speed), so that the maximum acceleration value αmin is determined as the maximum acceleration value α in Steps S5A and S5B as shown in FIG. 3. As described above, since the speed change of the speed target value V1 is larger than the maximum acceleration value αmin, the acceleration is regulated in the steps S5C to S5E, so that the speed target value V1 is corrected to the speed target value V1' in alignment with a chain line (inclination of αmin) in FIG. 10A.

Alternatively, for instance, when the working equipment lever 5 is inclined and the working equipment lever 5' is also inclined, in other words, when both of the boom 41 and the arm 42 are moved, and when the motion speed E of the arm is 50% or more relative to the maximum motion speed, the maximum acceleration value αmax is determined as the maximum acceleration value α in the steps S5A and S5B in Steps S5A and S5B as shown in FIG. 3.

As described above, since the speed change of the speed target value V1 is smaller than the maximum acceleration value αmax, the acceleration is not regulated in the steps S5C to S5E, so that the speed target value V1 is defined as the speed target value V1'.

(f) Step S6: Next, the floating motion suppressing unit 625 computes the speed target value V2 from the speed target value V1' according to the above-described formula (1) with use of the frequency ω and the damping coefficient ζ obtained in the step S4.

(g) Step S7: Then, the command signal output unit 63 is actuated. The command signal output unit 63 converts the corrected speed target value V2 to the command signal H and outputs the command signal H to the EPC valve 13*a*.

(h) Step 8: When the spool 111*a* of the main valve 11*a* is moved due to a pilot pressure from the EPC valve 13*a*, the command signal output unit 63 monitors a position of the spool 111*a* based on a position signal F fed back from the position sensor 112*a*, and outputs the command signal H so that the spool 111*a* maintains a precise position.

With the operations as described above, the boom 41 is driven due to a hydraulic fluid pressure from the main valve 11*a*, and in the moment when an operation of the boom 41 is started or an operation of the boom 41 at a certain speed is stopped, this main valve 11*a* operates based on the speed target value V2, so that vibrations of the boom 41 are canceled by the vibration characteristics of the boom 41 itself, so that the boom 41 moves according to the corrected speed target value V1'. In short, not only vibrations of the boom 41 but also the floating motion of the undercarriage 2 are suppressed.

Figure 10B:
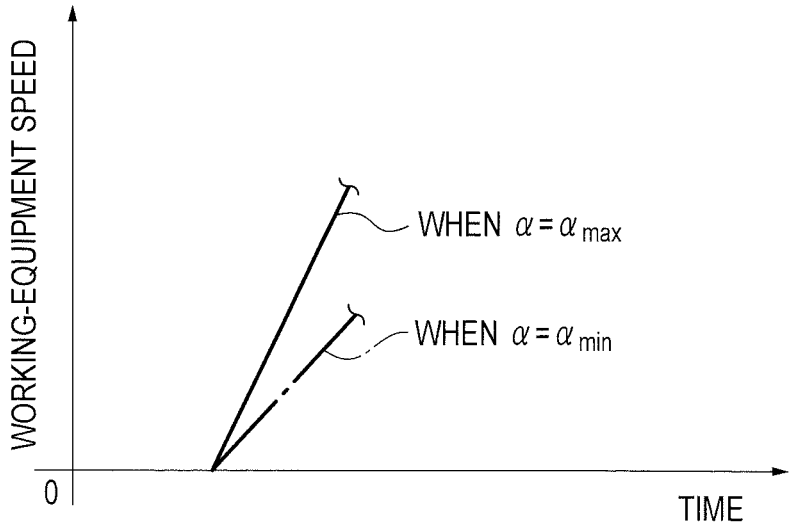
FIG. 10B is an illustration for explaining a speed of the working equipment after the acceleration regulating process.

For instance, when the boom 41 is singly moved as described above and the acceleration is regulated and the speed target value V1 is corrected so as to align with the chain line in FIG. 10A (inclination of αmin), the boom 41 slowly moves according to the speed target value V1' as shown in the chain line in FIG. 10B in the steps S6 to S8.

For instance, when both of the boom 41 and the arm 42 are moved as described above and the speed target value V1 is defined as the speed target value V1' without regulating the acceleration in the step S5, the boom 41 quickly moves according to the corrected speed target value V1' as shown in the solid line in FIG. 10B in the steps S6 to S8.

(4) Advantages of Exemplary Embodiment

According to the exemplary embodiment as described above, the following advantages are provided.

The valve controller 6*a* mounted on the hydraulic excavator 1 includes the motion information acquiring unit 622, the maximum value determining unit 623, the correction value regulating unit 624 and the floating motion suppressing unit 625.

With this arrangement, when the motion speed E of the arm 42 is relatively small as 10% or less relative to the maximum motion speed (e.g., when the boom 41 is singly moved) and the boom 41 is rapidly started or stopped, the boom 41 can slowly move by regulating the speed change ΔV1 of the boom 41 at the relatively small maximum acceleration value αmin. In short, the floating motion of the undercarriage 2 as a reaction to a motion of the boom 41 can be sufficiently suppressed.

When the motion speed E of the arm 42 is as relatively large as 50% or more relative to the maximum motion speed (e.g., when both of the boom 41 and the arm 42 are moved) and the boom 41 is rapidly started or stopped, the boom 41 can quickly move by regulating the speed change ΔV1 of the boom 41 at the relatively large maximum acceleration value αmax to suppress the acceleration regulation for the boom 41. In short, a quick motion of the boom 41 has priority over the advantages of suppressing the floating motion of the undercarriage 2 as a reaction to a motion of the boom 41.

As described above, levels of the function to suppress the floating motion can vary in accordance with the motion speed E of the arm 42.

Accordingly, in an operation of scraping topsoil on the ground flat by moving both of the boom 41 and the arm 42, the function to suppress the floating motion is weakly operated to quickly move the boom 41, so that a locus of the blade tip of the bucket 43 can be kept substantially horizontal and operability of the working equipment 4 can be enhanced.

When both of the boom 41 and the arm 42 are moved in the operation of scraping topsoil on the ground flat, although the acceleration regulation for the boom 41 is suppressed as described above, the hydraulic fluid discharged from the hydraulic pump 12 is distributed into the boom driving device 14 and the arm driving device 15.

Accordingly, even when the command signal H exceeding the maximum acceleration for moving the boom 41 is outputted to the boom driving device 14 by suppressing the acceleration regulation for the boom 41, since the hydraulic fluid fed to the boom driving device 14 is regulated by an amount of the hydraulic fluid fed to the arm driving device 15, the boom 41 moves only at an acceleration lower than the maximum acceleration corresponding to the amount of the hydraulic fluid fed to the arm driving device 15. Accordingly, the floating motion of the undercarriage 2 does not occur.

Since the motion speed E of the arm 42 is actually detected and the maximum acceleration value $\alpha$ is determined in accordance with the detected motion speed E, the maximum acceleration value $\alpha$ and the levels of the function to suppress the floating motion can be appropriately determined. Particularly, in the operation of scraping topsoil on the ground flat, the boom 41 is moved at an appropriate motion speed in accordance with the motion speed E of the arm 42, so that the operation can be efficiently carried out.

The maximum acceleration value $\alpha$ is set so as to increase from the maximum acceleration value $\alpha min$ to the maximum acceleration value $\alpha max$ at a predetermined ratio in a range of 10% to 50% of the motion speed E of the arm 42 relative to the maximum motion speed thereof. This arrangement can prevent a rapid change in levels of the acceleration regulation for the boom 41 in accordance with the motion speed E of the arm 42 and also can prevent a rapid change from a slow motion to a quick motion of the boom 41.

Moreover, the most characteristic structures of this exemplary embodiment, i.e., the motion information acquiring unit 622, the maximum value determining unit 623, the correction value regulating unit 624 and the floating motion suppressing unit 625, which are provided by software, do not require another separate member and can easily be installed in the valve controller 6*a* of the existing hydraulic excavator 1, so that the acceleration regulation and the floating motion suppression can be realized without increase in costs.

Second Exemplary Embodiment

Next, a second exemplary embodiment of the invention will be described below. In the following description, the same components as those described above will be indicated by the same reference numerals and the description thereof will be omitted.

Figure 11:
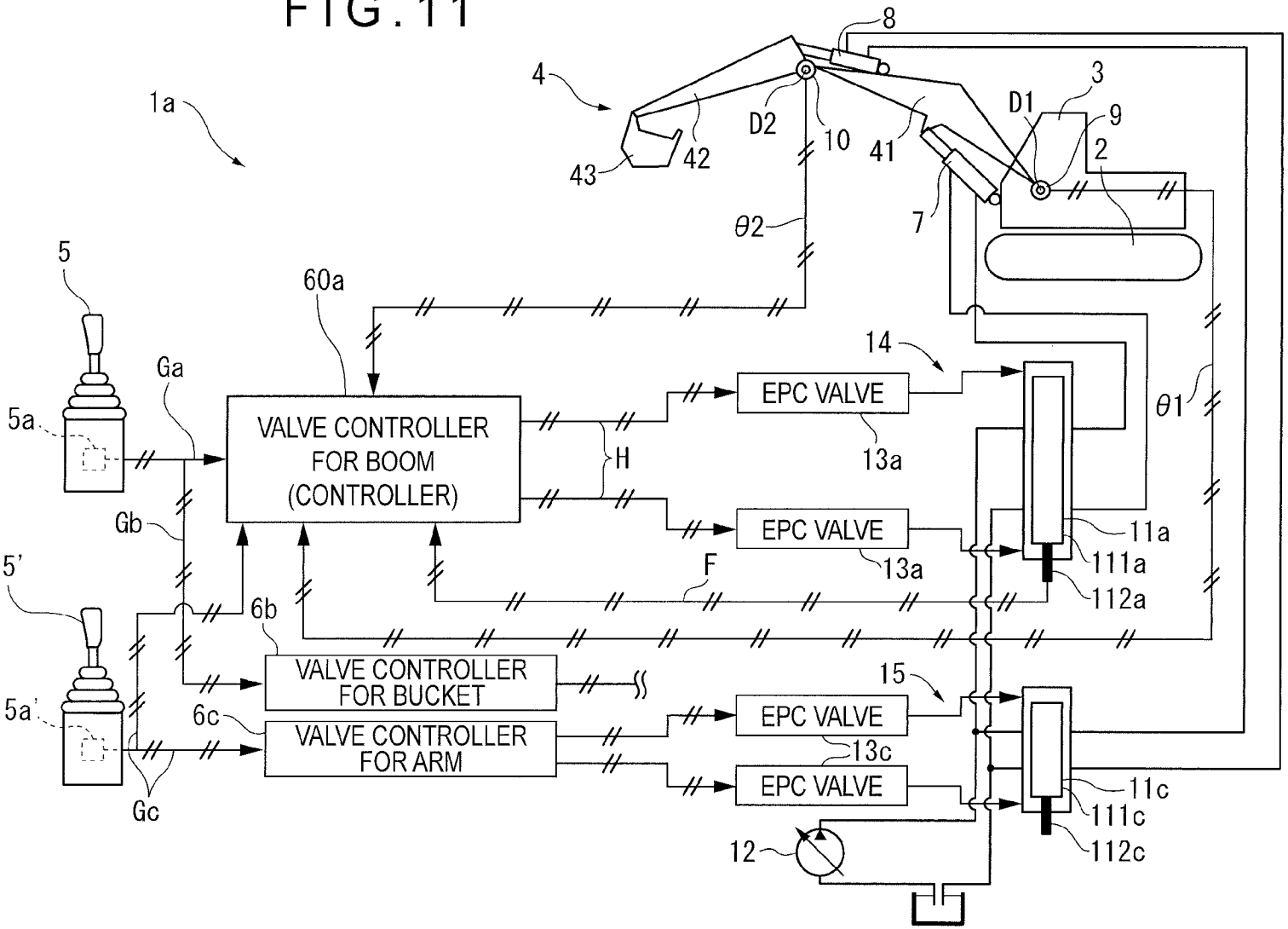
FIG. 11 is a schematic diagram showing a construction machine according to a second exemplary embodiment of the invention.

FIG. 11 is a schematic diagram showing a hydraulic excavator (construction machine) 1*a* according to the second exemplary embodiment of the invention.

Figure 12:
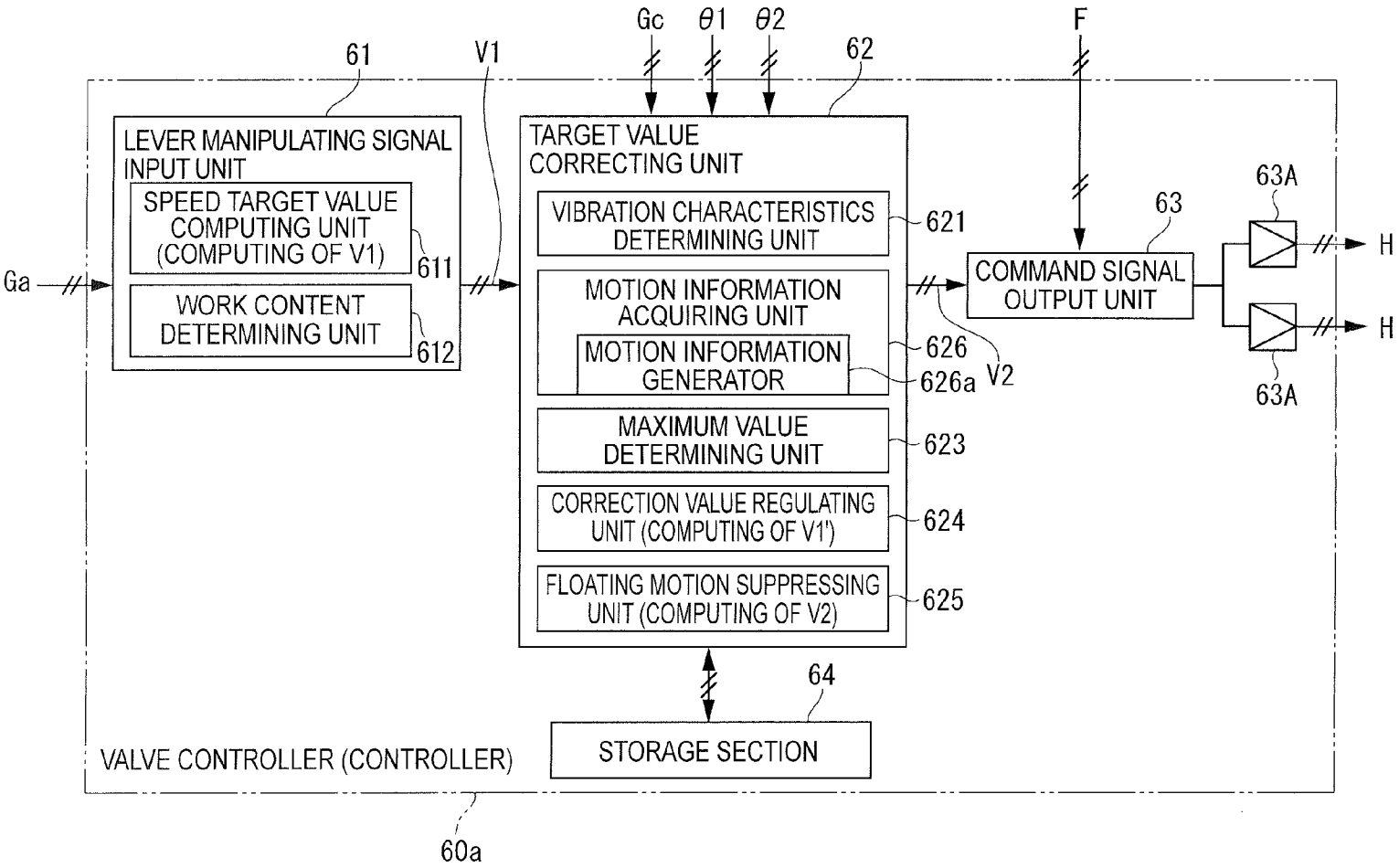
FIG. 12 is a block diagram showing a valve controller.

FIG. 12 is a block diagram showing a valve controller 60*a*.

The valve controller 6*a* according to the first exemplary embodiment determines the maximum acceleration value $\alpha$ in accordance with the actually detected motion speed E of the arm 42 for the acceleration regulating process.

In contrast, the valve controller 60*a* according to the second exemplary embodiment is different from the valve controller 6*a* according to the first exemplary embodiment in that the valve controller 60*a* generates a motion speed of the arm 42 based on a lever manipulating signal Gc from an angle sensor (displacement sensor) 5*a*' provided in the working equipment lever 5'.

Specifically, in the second exemplary embodiment, a motion information acquiring unit 626 constituting the valve controller 60*a* includes a motion information generator 626*a* that generates a motion speed of the arm 42 based on a lever manipulating signal Gc, as shown in FIG. 12.

Here, the motion speed of the arm 42 corresponding to the lever manipulating signal Gc, which changes in conjunction with a change of the lever manipulating signal Gc, is previously calculated for an actual vehicle and is stored in the storage section 64.

Accordingly, when the lever manipulating signal Gc is inputted, the motion speed of the arm 42 corresponding to the lever manipulating signal Gc is immediately retrieved from the storage section 64, and is used by the maximum value determining unit 623.

A method for controlling the working equipment 4 in the second exemplary embodiment is substantially the same as that in the first exemplary embodiment as described above and is different only in that the motion information generator 626*a* generates the motion speed of the arm 42 based on the lever manipulating signal Gc in the step S5A shown in FIG. 9.

In addition to the advantages described in the first exemplary embodiment, the following advantages are provided by the second exemplary embodiment.

Specifically, since an angle sensor having the same structure as the angle sensor 5*a* for the boom 41 can be used as the angle sensor 5*a*' for the arm 42, the speed sensor 16 according to the first exemplary embodiment and the like are not required separately, so that a structure can be simplified.

Third Exemplary Embodiment

Next, a third exemplary embodiment of the invention will be described below.

Figure 13:
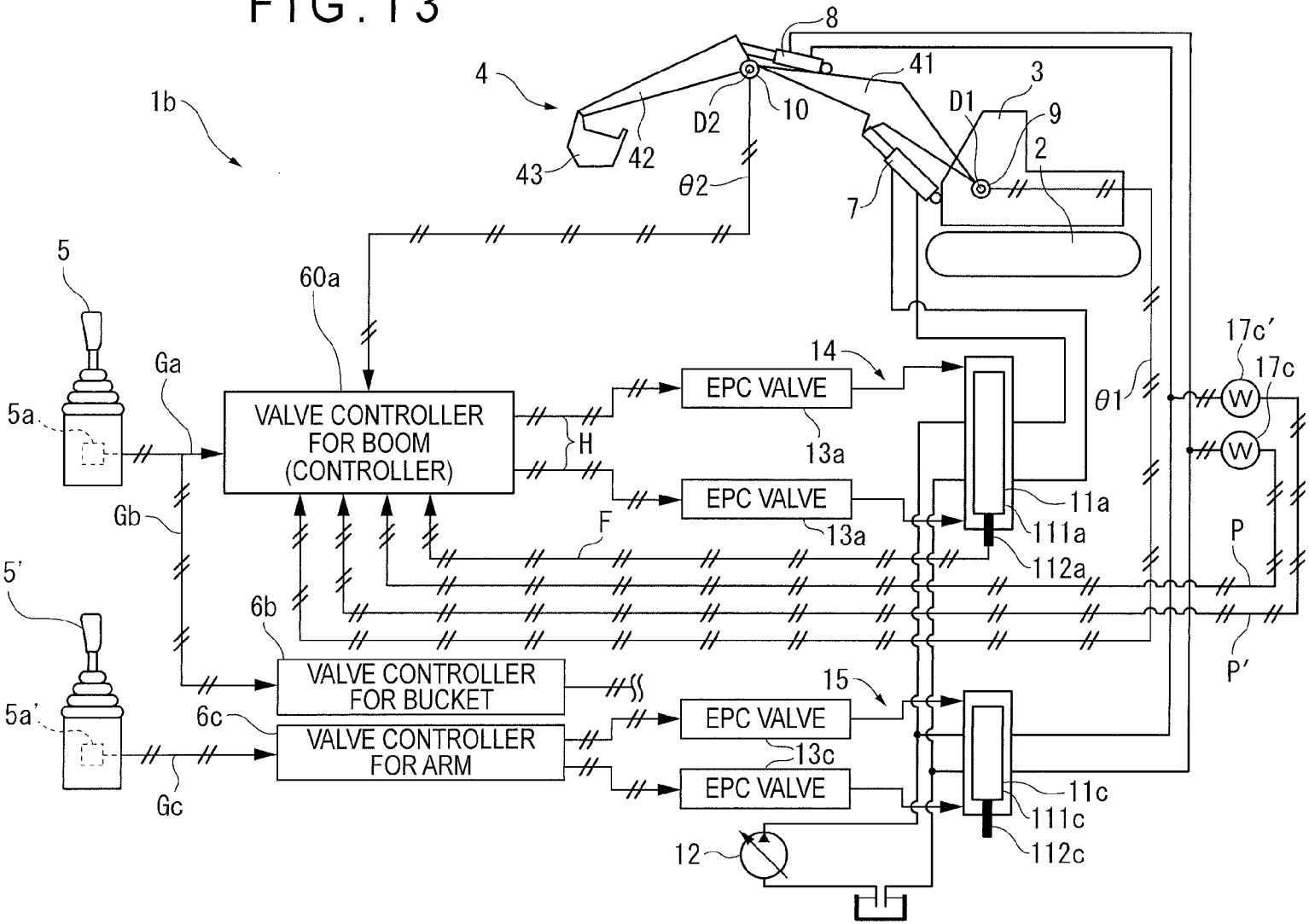
FIG. 13 is a schematic diagram showing a construction machine according to a third exemplary embodiment of the invention.

FIG. 13 is a schematic diagram showing a hydraulic excavator (construction machine) 1*b* according to a third exemplary embodiment of the invention.

The valve controller 60*a* according to the second exemplary embodiment generates the motion speed of the arm 42 based on the lever manipulating signal Gc.

In contrast, as shown in FIG. 13, the valve controller 60*a* according to the third exemplary embodiment is different from the valve controller 60*a* according to the second exemplary embodiment in that the valve controller 60*a* according to the third exemplary generates a motion speed of the arm 42 based on hydraulic fluid pressure P and P' detected by pressure sensors 17*c* and 17*c*' provided to a hydraulic fluid feed path and a hydraulic fluid discharge path between the main valve 11*c* and the hydraulic cylinder 8 in the arm driving device 15.

Specifically, when a total weight of the arm 42 and the bucket 43 is m, the acceleration of the arm 42 is a, a cross-sectional area of an oil chamber of the hydraulic cylinder 8 near the rod is A and a cross-sectional area of an oil chamber of the hydraulic cylinder 8 near the head is A', the following formula (2) is satisfied.

Formula 2

$$ma = P' \times A - P \times A \quad (2)$$

The motion information generator 626*a* calculates an acceleration a of the arm 42 according to the formula (2) based on the hydraulic fluid pressure P and P' respectively detected by the pressure sensors 17*c* and 17*c*', and generates a motion speed of the arm 42 by integrating the calculated acceleration a.

With the arrangement according to the third exemplary embodiment, even when the motion speed of the arm 42 is generated based on the hydraulic fluid pressure P and P' respectively detected by the pressure sensors 17*c* and 17*c*', the same action and advantages as those in the first exemplary embodiment can be obtained.

Modifications of Exemplary Embodiments

The scope of the invention is not limited to the above-described exemplary embodiments, but includes other configurations and the following modifications as long as an object of the invention can be achieved.

In the above exemplary embodiments, the floating motion suppressing unit 625 is employed as the floating motion suppressing unit of the invention. However, the floating motion suppressing unit of the invention is not limited to the floating motion suppressing unit 625 as long as the floating motion of the undercarriage 2 as a reaction to the motion of the boom 41 is suppressed by slowly moving the boom 41 when the boom 41 is rapidly started or stopped.

For instance, such a structure that a throttle is provided in a pilot circuit between the EPC valve 13*a* and the main valve 11*a*, and when the boom 41 is rapidly started or stopped, the boom 41 is slowly moved by decreasing the pilot pressure from the EPC valve 13*a* with the throttle may be used as the floating motion suppressing unit.

Alternatively, for instance, for a rapid start or a rapid stop of the boom 41, such a structure that the boom 41 is slowly moved by decreasing the change amount per hour of the command signal H to the boom driving device 14 to regulate the flow rate of the hydraulic fluid to the hydraulic cylinder 7 may be used as the floating motion suppressing unit.

In the above exemplary embodiments, the invention is applied to the hydraulic excavator, but is not limited thereto.

For instance, the invention is applicable to an electric shovel provided with the boom driving device and the arm driving device including an electric motor and the like. Even when the invention is used in the electric shovel, such a structure that electric power is distributed to the boom driving device and the arm driving device is preferable.

In the above exemplary embodiments, the maximum acceleration value $\alpha$ is limited to the determined value as shown in FIG. 3. In other words, the motion speed E of 10% or 50% relative to the maximum motion speed as shown in FIG. 3 is only $\alpha$ value for convenience of descriptions and may be changed as required.

In the second and third exemplary embodiments, the motion speed of the aim 42 is generated based on the lever manipulating signal Gc and the hydraulic fluid pressure P, but not limited thereto.

For instance, the motion speed of the atm 42 may be generated based on the joint angle $\theta$2 of the arm 42 by the angle sensor 10.

Alternatively, for instance, an acceleration sensor may be attached to the arm 42 and hydraulic cylinder 8, and the motion speed of the arm 42 may be generated based on an actual motion acceleration of the arm 42 and an actual motion acceleration of the hydraulic cylinder 8 which are detected by the acceleration sensor.

The invention ultimately aims at controlling the acceleration as described in the above exemplary embodiments, but the invention includes the structure for controlling the following:

(1) a change ratio of the command signal (electrical signal) H from the valve controller 6*a;*

(2) a change ratio of the pilot pressure from the EPC valve 13*a;*

(3) a moving speed of the spool 111*a* in the main valve 11*a;*

(4) a time change ratio of an opening volume of the main valve 11*a;*

(5) driving pressure of the hydraulic cylinder 7; and (6) an inverter current value when the boom driving device includes an electric motor.

Although the best arrangement, method, and the like for carrying out the invention have been described above, the scope of the invention is not limited thereto. In other words, although particular embodiments of the invention are mainly illustrated and described, a variety of modifications may be made by those skilled in the art on shapes, amounts, and other detailed arrangements of the embodiments as described above without departing from the spirit and object of the invention.

Thus, a shape, quantity and the like described above merely serve as exemplifying the invention for facilitating an understanding of the invention, and do not serve as any limitations on the invention, so that what is described by a name of a component for which the description of the shape, quantity and the like are partially or totally omitted is also included in the invention.

The invention claimed is:

1. A construction machine comprising:

an undercarriage;

an upper revolving body;

a working equipment provided with a boom and an arm, the working equipment being provided on the upper revolving body;

a floating motion suppressing unit that suppresses a floating motion of the undercarriage corresponding to a motion of the boom; and a controller that controls the working equipment, wherein power to the working equipment is distributed and fed to a boom driving device that moves the boom and an arm driving device that moves the arm, the controller comprises:

a manipulating signal input unit comprising a target value computing unit that generates a motion target value of the boom based on a manipulating signal inputted by a boom manipulating unit that manipulates the boom;

a target value correcting unit that corrects the motion target value; and a command signal output unit that outputs a command signal to the boom driving device based on the corrected motion target value, and the target value correcting unit comprises:

a motion information acquiring unit that acquires a motion information of the arm, the motion information being a motion speed of the arm relative to the boom and being based on one of a manipulation command of the arm and a motion of the arm;

a maximum value determining unit that determines, based on the motion information, a maximum correction value for reducing suppression of a floating motion by the floating motion suppressing unit based on the motion speed of the arm becoming greater than a predetermined motion speed; and a correction value regulating unit that corrects the motion target value based on the maximum correction value.

2. The construction machine according to claim 1, further comprising:

a speed sensor that detects the motion speed of the arm, wherein the motion information acquiring unit acquires the motion speed detected by the speed sensor as the motion information.

3. The construction machine according to claim 1, further comprising:

a displacement sensor that detects a displacement of an arm manipulating lever that manipulates the arm, wherein the motion information acquiring unit comprises a motion information generator that generates the motion information based on the displacement detected by the displacement sensor.

4. The construction machine according to claim 1, further comprising:

a boom actuator as an output unit of the boom driving device and an arm actuator as an output unit of the arm driving device, the boom actuator and the arm actuator being driven by fluid pressure of hydraulic fluid to be fed; and a pressure sensor that detects the fluid pressure of the hydraulic fluid fed to the boom actuator and the arm actuator, wherein the motion information acquiring unit comprises a motion information generator that generates the motion information based on the fluid pressure detected by the pressure sensor.

5. A method for controlling a construction machine comprising: an undercarriage; an upper revolving body; a working equipment provided with a boom and an arm, the working equipment being provided on the upper revolving body; a floating motion suppressing unit that suppresses a floating motion of the undercarriage corresponding to a motion of the boom; and a controller that controls the working equipment, wherein power to the working equipment is distributed and fed to a boom driving device that moves the boom and an arm driving device that moves the arm, and the method is performed by the controller, the method comprising:

generating a motion target value of the boom based on a manipulating signal inputted by a boom manipulating unit that manipulates the boom;

acquiring a motion information of the arm, the motion information being a motion speed of the arm relative to the boom and being based on one of a manipulation command of the arm and a motion of the arm;

determining, based on the motion information, a maximum correction value for reducing suppression of a floating motion by the floating motion suppressing unit based on the motion speed of the arm becoming greater than a predetermined motion speed; and correcting the motion target value based on the maximum correction value.

6. A non-transitory computer-readable medium storing software comprising instructions executable by one or more computers, which, upon such execution, cause the one or more computers to perform operations for controlling a construction machine, the construction machine comprising: an undercarriage; an upper revolving body; a working equipment provided with a boom and an arm, the working equipment being provided on the upper revolving body; and a floating motion suppressing unit that suppresses a floating motion of the undercarriage corresponding to a motion of the boom, wherein power to the working equipment is distributed and fed to a boom driving device that moves the boom and an arm driving device that moves the arm, the operations comprising:

generating a motion target value of the boom based on a manipulating signal inputted by a boom manipulating unit that manipulates the boom;

acquiring a motion information of the arm, the motion information being a motion speed of the arm relative to the boom and being based on one of a manipulation command of the arm and a motion of the arm;

determining, based on the motion information, a maximum correction value for reducing suppression of a floating motion by the floating motion suppressing unit based on the motion speed of the arm becoming greater than a predetermined motion speed; and correcting the motion target value based on the maximum correction value.

7. The construction machine according to claim 1, wherein the upper revolving body is revolvably provided above the undercarriage, and wherein the boom driving device moves the boom relative to the upper revolving body.

8. The construction machine according to claim 1, wherein the motion information acquiring unit acquires motion information on the motion of the arm relative to the boom.

9. The method according to claim 5, wherein the upper revolving body is revolvably provided above the undercarriage, and wherein the boom driving device moves the boom relative to the upper revolving body.

10. The method according to claim 5, wherein acquiring motion information on the motion of the arm includes acquiring motion information on the motion of the arm relative to the boom.

11. The non-transitory computer-readable medium according to claim 6, wherein the upper revolving body is revolvably provided above the undercarriage, and wherein the boom driving device moves the boom relative to the upper revolving body.

12. The non-transitory computer-readable medium according to claim 6, wherein the operations include acquiring motion information on the motion of the arm relative to the boom.

13. The construction machine according to claim 1, wherein the floating motion suppressing unit is configured to suppress a front side or a back side of the undercarriage from floating.

14. The construction machine according to claim 1, wherein the floating motion suppressing unit is configured to suppress the floating motion of the undercarriage corresponding to an upward or a downward motion of the boom.

15. The construction machine according to claim 1, wherein the motion information acquiring unit is configured to acquire the motion information that is based on the manipulation command of the arm.

16. The construction machine according to claim 1, wherein the motion information acquiring unit is configured to acquire the motion information that is based on the motion of the arm.

17. The method according to claim 5, wherein acquiring the motion information of the arm includes acquiring the motion information that is based on the manipulation command of the arm.

18. The method according to claim 5, wherein acquiring the motion information of the arm includes acquiring the motion information that is based on the motion of the arm.

19. The non-transitory computer-readable medium according to claim 6, wherein the operations include acquiring the motion information that is based on the manipulation command of the arm.

20. The non-transitory computer-readable medium according to claim 6, wherein the operations include acquiring the motion information that is based on the motion of the arm.

* * * * *